United States Patent [19]

Ivey

[11] Patent Number: 4,909,661

[45] Date of Patent: Mar. 20, 1990

[54] ADVANCED DYNAMIC IMPACT EXTENSION MODULE

[75] Inventor: Don L. Ivey, Bryan, Tex.

[73] Assignee: The Texas A&M University System, College Station, Tex.

[21] Appl. No.: 316,073

[22] Filed: Feb. 27, 1989

Related U.S. Application Data

[63] Continuation-in-part of Ser. No. 124,499, Nov. 23, 1987, Pat. No. 4,822,208.

[51] Int. Cl.[4] ..... E01F 13/00; E01F 15/00

[52] U.S. Cl. ..... 404/6; 404/9; 256/13.1; 188/377

[58] Field of Search ..... 404/6, 9, 10; 256/1, 256/13.1; 52/174; 188/371, 377; 49/9

[56] References Cited

U.S. PATENT DOCUMENTS

| | | | |
|---|---|---|---|
| 1,551,556 | 9/1925 | Gust | 404/6 |
| 1,940,994 | 12/1933 | Callaghan | 404/6 |
| 3,141,655 | 7/1964 | Platt | 256/13.1 |
| 3,880,404 | 4/1975 | Fitch | 404/6 |
| 3,881,697 | 5/1975 | Glaesner | 256/13.1 |
| 3,967,704 | 7/1976 | Ogden | 188/377 |
| 4,073,482 | 2/1978 | Seegmiller et al. | 404/6 |
| 4,290,585 | 9/1981 | Glaesner | 404/6 |
| 4,298,419 | 9/1981 | Young et al. | 404/6 |
| 4,321,989 | 3/1982 | Meinzer | 256/13.1 |
| 4,399,980 | 8/1983 | van Schie | 188/377 |
| 4,423,854 | 1/1984 | Cobb et al. | 256/13.1 |
| 4,552,341 | 11/1985 | Zucker et al. | 256/13.1 |
| 4,681,302 | 7/1987 | Thompson | 404/6 |
| 4,822,208 | 4/1989 | Ivey | 256/13.1 |

OTHER PUBLICATIONS

Evaluation of Crash Cusions Constructed of Lightweight Cellular Concrete, Ivey, et al, 1972 Highway Research Record No. 386 (pp. 10, 11, 17, 18).

Crash Tests of an Articulated Energy-Absorbing Gore Barrier Employing Lightweight Concrete Cartridges, Walker, et al., 1972 Highway Research Record No. 386 (pp. 19, 20, 22).

Feasibility of Lightweight Cellular Concrete for Vehicle Crash Cushions, Ivey, et al, Committee on Guardrail, Median Barriers and Sign, Signal and Lighting Supports (First and last page of article).

*Primary Examiner*—Stephen J. Novosad
*Assistant Examiner*—Gay Spahn
*Attorney, Agent, or Firm*—Arnold, White & Durkee

[57] ABSTRACT

An advanced dynamic impact extension module, used to protect occupants of vehicles from the adverse effects of extremely rapid deacceleration of a vehicle when the vehicle impacts an end of a concrete barrier wall is disclosed. According to the invention, a barrier wall is provided which has a structural concrete base and a channel portion adaptable to receive low strength reinforced concrete modules. The concrete modules are composed of three layers of crushable material of varying strengths. The first or lowest layer is composed of semi-crushable, higher strength concrete and which is adaptable to secure reinforcement and S-beam connectors. The second layer is lower strength material and the top layer is intermediate strength material. The second and top layer keep an impacting vehicle down and prevent ramping. The modules are arranged linearly beginning at a front end closest to the path of an oncoming vehicle and proceeding toward a back end proximate a roadside obstacle. An impacting vehicle will crush the modules in succeeding fashion according to its impact velocity. The last module in the linear array has triangular steel reinforcement which will cause the impacting vehicle to rise up to avoid the roadside obstacle if the impacting vehicle has sufficient impact force or velocity to crush all the preceding modules. The structural concrete base will coact with the undercarriage of the vehicle in order to bring the vehicle safely to rest before it impacts the roadside obstacle. The height or elevation of the non-crushable concrete base of the barrier will increase in step-wise or sloping fashion so that as a vehicle passes through the barrier, the increased height of the base portions of the barrier base coact with the bottom, or undercarriage, of the vehicle to create friction and drag between the bottom of the vehicle and the base component of the barrier to thereby bring the vehicle to rest before it impacts the end of a concrete barrier wall.

19 Claims, 8 Drawing Sheets

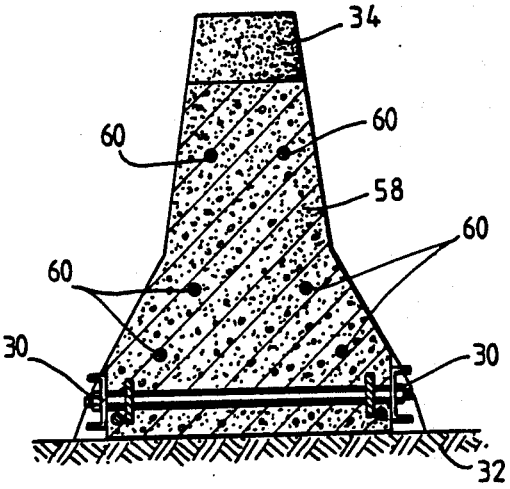
Fig. 5
Fig. 6
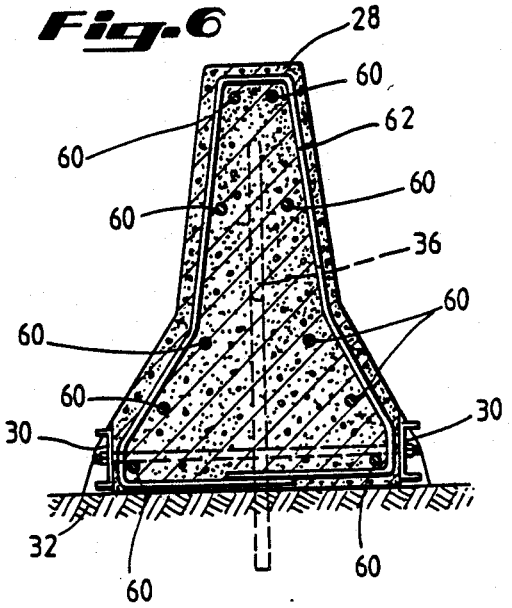
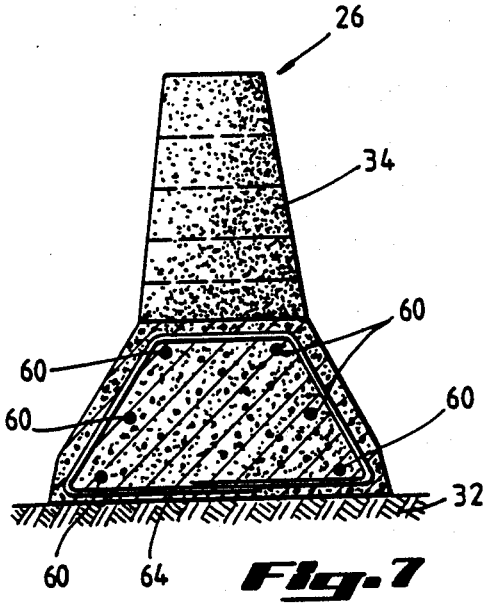
Fig. 7
Fig. 8
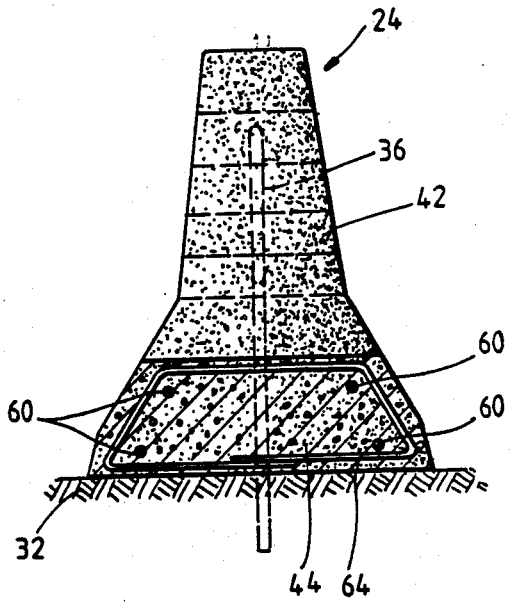

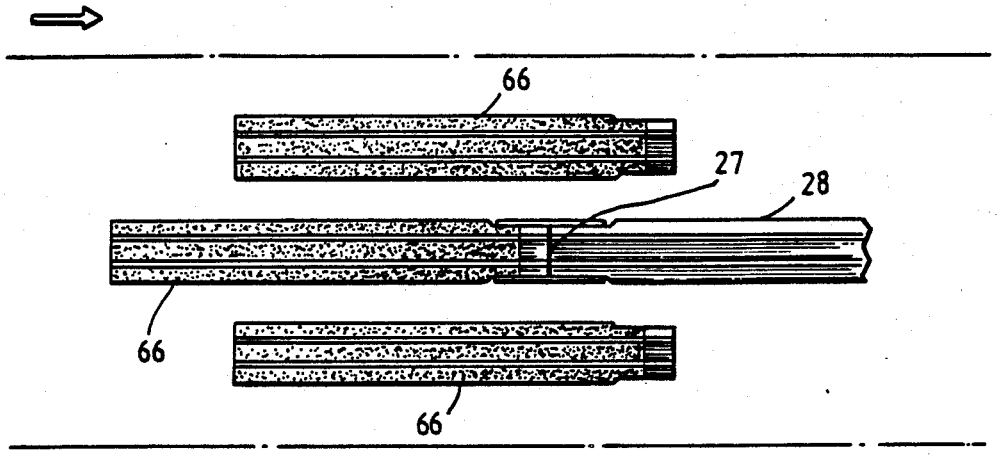
Fig. 9
Fig. 10
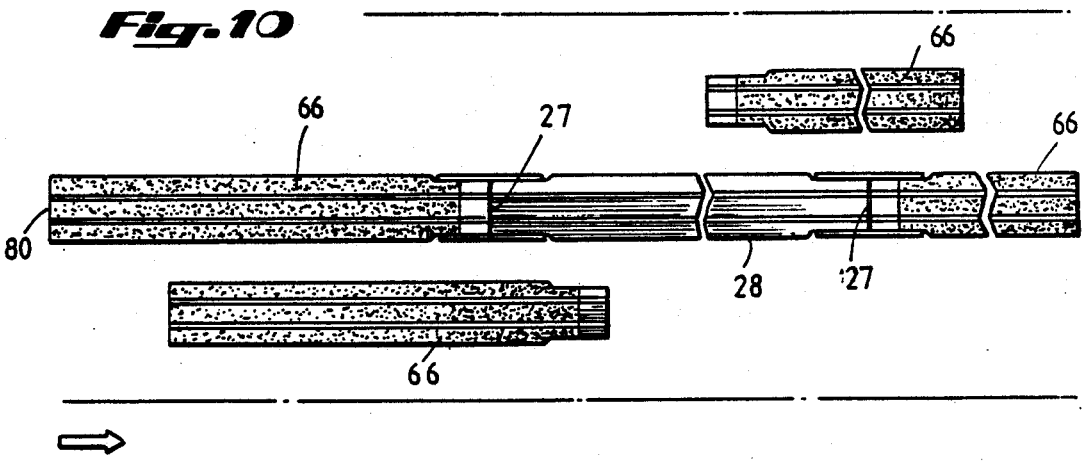
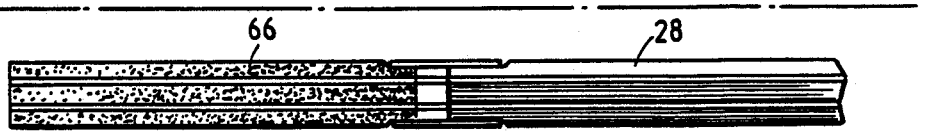
Fig. 11

FIG.17
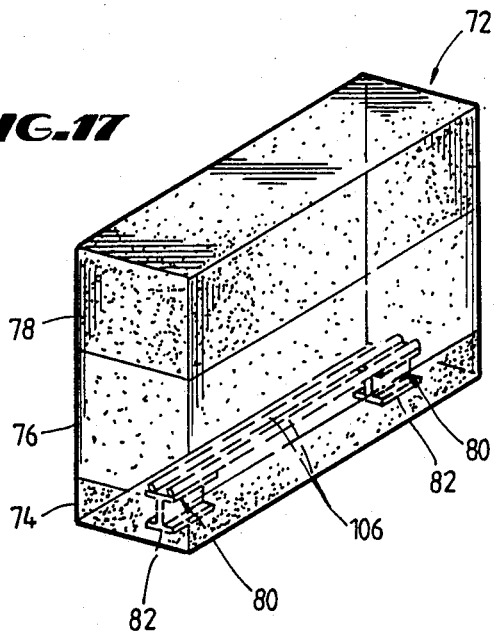
FIG.15
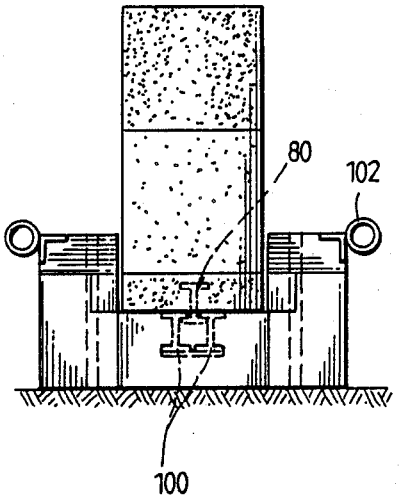
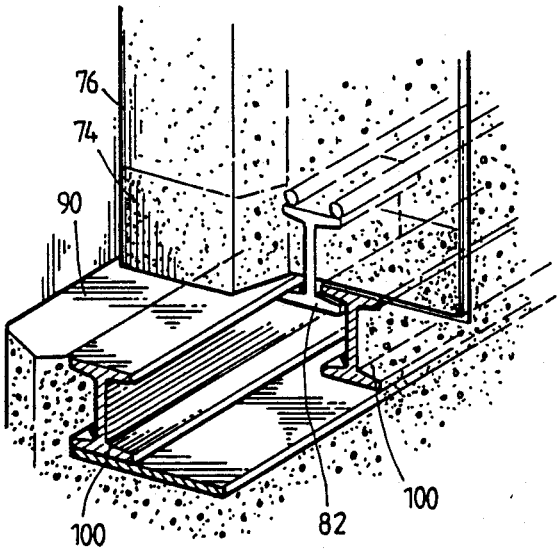
FIG.20
FIG.16
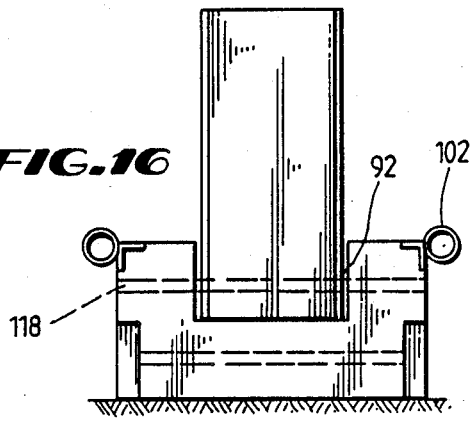

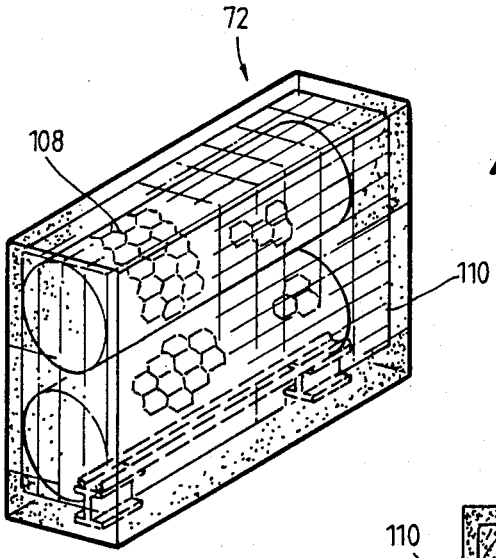
FIG.18
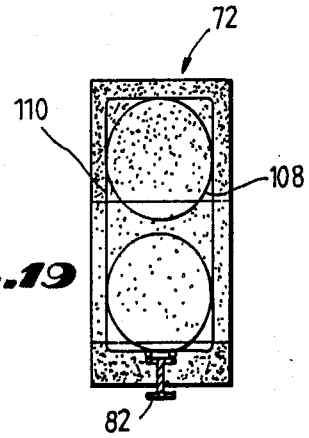
FIG.19
FIG.21
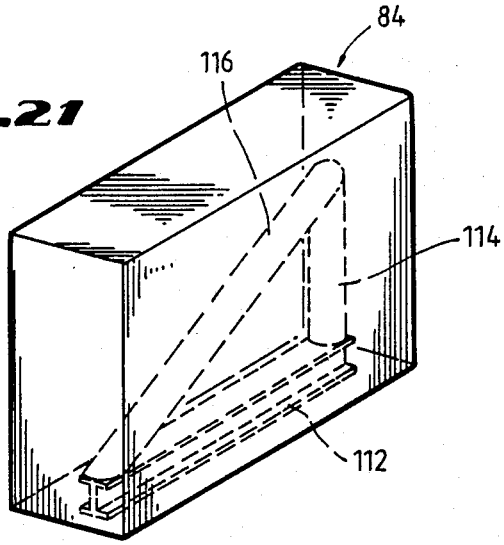

ADVANCED DYNAMIC IMPACT EXTENSION MODULE

REFERENCE TO RELATED APPLICATION

The present invention is a continuation-in-part of an application Ser. No. 124,499 filed Nov. 23, 1987 now U.S. Pat. No. 4,822,208 by Applicant of the present Application. That parent application has been allowed and Applicant is awaiting its issuance as a patent.

BACKGROUND OF THE INVENTION

The present invention relates generally to roadside or roadway barriers used to prevent vehicles from crossing from the lane of traffic that they are traveling in to an opposite or adjacent lane, carrying vehicles traveling in an opposite direction. The present invention also relates to barrier modules which prevent vehicles from entering into any hazardous area on the roadway. In this manner, roadway barriers prevent head-on collisions on the highways and collisions with other hazardous objects. The present invention also relates to roadside barriers which prevent vehicles from leaving the highway and colliding with fixed roadside obstacles.

Specifically, the present invention relates to an improvement in the end treatment of a concrete barrier wall. The apparatus according to the present invention is specifically designed to reduce the chances of serious injury to the occupants of a vehicle which impacts an end of a concrete barrier wall.

The primary function of a concrete barrier wall is to redirect errant vehicles back into the flow of traffic without allowing the vehicle to leave the roadway or cross into oncoming lanes of traffic. Further, the barrier should redirect the errant vehicle without seriously injuring the occupants of the vehicle. Secondarily, the barrier should also protect against collisions with roadside obstructions, which may be power poles or bridge abutments. Protection of the obstruction may also be important, for a power pole downed by an errant vehicle may mean a loss of electrical power for large numbers of people. Similarly, a damaged bridge abutment is very costly to repair and may mean closed thoroughfares until the damage has been repaired. Most importantly, however, concrete barriers prevent loss of life caused by "head-on" collisions between vehicles. And, although known prior art barriers have accomplished these objectives, they have all been marked by a common, serious disadvantage. The blunt end of the concrete barrier, facing the oncoming traffic, has proven to be very hazardous.

Typically, the end of a concrete barrier wall has been either a blunt, fist shaped end; a blunt end protected by a disposable, "single-event" cushion; or an end protected by a sloping concrete or metal guardrail end-treatment. All of these known barrier wall end-treatments have proven to be unsatisfactory, either for economic or functional reasons.

The known blunt end-treatments for concrete barrier walls have proven to be unsatisfactory because a vehicle impacting the blunt end "head-on", is stopped so abruptly that the occupants of the vehicle are most often severely injured or even killed. In a similar manner, many disposable "single-event" cushions used to protect these blunt barrier wall ends have proven to be ineffectual for the same reason. Further, other known "single-event" cushions have proven to be unsatisfactory because they are only partially effective when a vehicle impacts the end of a barrier wall at a high rate of speed. The few known "single-event" cushions that do perform well are extremely costly.

Finally, concrete or metal guardrail end-treatments, which provide a top surface which slopes gently from the ground up to the top of the concrete barrier wall, often cause severe injury to the occupants of a vehicle which, when encountering these sloping end treatments, ramps up onto the end treatment and is guided directly to the top of the concrete barrier wall where the concrete barrier wall acts as a rail which will often either: (a) cause the vehicle to roll, thereby causing injury to the occupants of the vehicle; or (b) guide the errant vehicle directly into a roadside obstacle, thereby severely injuring the occupants of the vehicle when the vehicle impacts the obstacle.

The known concrete barrier wall end-treatments of the prior art, therefore, have all been distinguished by fundamental drawback: they are unable to deaccelerate a vehicle impacting the end of a concrete barrier wall in such a manner so as to avoid serious injury to the occupants, or they do so at a cost that is unreasonable from societal investment standpoint.

SUMMARY OF THE INVENTION

The present invention deals with the previously marginally solved problem of prior art concrete barrier wall end-treatments, by providing an advanced dynamic impact extension module which, when placed before the end of a concrete barrier wall, protects the occupants of a vehicle by progressively absorbing the force of impact of the vehicle before the vehicle reaches the end of the concrete barrier wall. A roadside barrier according to the present invention is also able to be quickly and inexpensively installed at the end of a concrete barrier wall, and may be manufactured at a site remote from the concrete barrier wall to which it s attached.

In accordance with a preferred embodiment of the present invention, a number of barrier modules, having cross-sections somewhat similar to the concrete barrier wall which they protect, are arranged linearly, in an array extending away from the end of the concrete barrier wall, in a direction leading parallel to, and toward the flow of traffic.

The sections are preferably arranged so that the longitudinal axes of the sections are aligned with one another and are also aligned with the longitudinal axis of the concrete barrier wall which they protect.

According to this embodiment of the present invention, a first roadside barrier section is a composite section comprised of reinforced concrete and a low density crushable material placed atop the reinforced concrete base. This first section is configured to closely match the existing concrete barrier wall so that the cross-section of this first section is substantially identical to the cross-sectional configuration of the concrete barrier wall which it protects. However, different cross-sections such as generally rectangular cross-sections can be utilized and still be within the contemplation of this invention.

In further accordance with the present invention, a plurality of intermediate sections are positioned linearly between the first composite section and the end of the concrete barrier wall. These intermediate sections are distinguishable in that the proportion of lower density, crushable material to reinforced concrete in each section decreases as the sections are placed closer to the end of the concrete barrier wall. In this manner, the first composite section may be comprised of substantially all low density, crushable material while the last intermediate section, positioned immediately adjacent the end of the concrete barrier wall, may be, at its back end, entirely reinforced concrete. Therefore, the amount of reinforced concrete in these intermediate sections increases from the first composite section to the last intermediate section positioned adjacent the end of the concrete barrier wall.

In accordance with the present invention, the lower density, crushable material is positioned above the reinforced concrete base of the roadside barrier so that a vehicle impacting the barrier will first encounter the crushable material which will tend to decrease the forward velocity of the vehicle and perhaps even to stop the vehicle. If, however, the vehicle is traveling with sufficient velocity so that the vehicle crushes all of the crushable material provided in the first composite section of the roadside barrier, the vehicle will continue to crush the lower density, crushable material provided in each of the intermediate sections.

As the vehicle moves through each of the intermediate roadside barrier sections, crushing the crushable material in its path, the undercarriage of the vehicle will also encounter, in step-wise fashion, greater heights of noncrushable, reinforced concrete provided in the lower, base portions of the intermediate sections of the roadside barrier. In this manner, as the vehicle passes through these intermediate sections and is slowed by the force required to crush the lower density, crushable material provided in the sections, the velocity of the vehicle will be further reduced by friction and drag produced on the bottom of the vehicle by the increased heights of the non-crushable, reinforced concrete bases of these sections acting on the vehicle.

In accordance with a second preferred embodiment of the present invention, a structural concrete base of reinforced concrete is provided adaptable at the upper surface to receive crushable modules. The structural concrete base is arranged so that its longitudinal axis is aligned with the longitudinal axis of a concrete barrier wall which it protects. The base has a back end immediately adjacent the concrete barrier wall. The base extends away from the end of the concrete barrier wall in a direction leading parallel to and toward the flow of traffic. The base end distally removed from the back end is the front end.

In accordance with this second preferred embodiment, the length of the concrete base and the number of modules sitting thereon is predetermined based on the anticipated number and velocity of vehicles traveling in the immediate vicinity where the barrier wall is desired to be placed. Where vehicles are anticipated to be traveling at a higher velocity, a correspondingly longer length of the barrier wall is needed to absorb the higher force of an impacting vehicle. Conversely, where it is anticipated that the vehicle will be traveling at slower rates of speed, the barrier wall can be shorter because less impact resistance is needed to bring the impacting vehicle to a stop.

The modules which are provided to sit atop the concrete base can be of any length. However, it is contemplated in a preferred form of this embodiment that the modules are of a length substantially shorter than the length of the concrete base and may be on the order of three feet in length. The number of module provided is determined by the length of the concrete base which length is itself determined based on the anticipated need and according to the anticipated velocity of the impacting vehicles.

According to this embodiment of the present invention, the width of the concrete base at its front end is substantially the same as the width of the crushable modules which are adapted to sit on top of the base. Beginning immediately at the front end of the base, the base begins an outward taper over a predetermined distance. This taper is necessary to provide a sufficient width of the concrete base on either side of the crushable modules which will be stepped up at intervals so as to define a channel in the concrete base and walls to provide reinforcement against the modules moving laterally with respect to the concrete base. Alternatively, the concrete base could be of a constant width throughout its entire length. In an alternative embodiment, the increase in height of the sides of the concrete base which form walls to the concrete base and define a channel portion therein may be provided by a gradual slope beginning at the front end of the base and increasing toward the back end. Holes, such as dowel holes, are provided at intervals in the wall sections of the concrete base to receive dowels to secure the entire barrier wall to a roadway surface. The back end of the concrete base is adapted to be fixedly attached to a roadside barrier which the barrier wall protects.

According to a preferred form of this embodiment of the present invention, the structural concrete base may be approximately 21 feet in length. Beginning at the front end, the base has an outwardly tapering cross-section for the first nine feet. The width of the base is about one foot at the front end and then gradually and uniformly increases to a width of two feet at a distance of nine feet from the front end. The width over the next ten feet of the base remains constant. The final two feet of the base which is adjacent the concrete barrier wall is modified for connection to a line of portable concrete barrier segments (PCB's). Holes are provided at strategic locations in the walls along the entire length of the concrete base through which anchoring dowels are inserted to secure the base to a roadway surface. Reinforcing steel is provided in the concrete base.

In further accordance with this embodiment, the channel of the structural concrete base runs the entire length of the base and is symmetrical to the center axis of the base. This channel is of sufficient width to receive the crushable modules of low strength material which will be slipped into place in the channel. In a preferred form of this embodiment, the modules are approximately 11 inches in width.

In further accordance with this embodiment, the elevation of the structural concrete base proceeds in a step-wise fashion stepping upward at defined intervals, or increases in a gradual slope, beginning from the front end of the structural concrete base towards the back end. As the vehicle moves downward along the length of the concrete base, progressively crushing the modules in its path according to its impact velocity, the undercarriage of the vehicle will also encounter the stepped or sloped increased height of the walls of the concrete base. In this manner, as the vehicle passes through these intermediate sections and is slowed by the force required to crush the lower density crushable material provided in the module sections, the velocity of the vehicle will be further reduced by the friction and drag produced on the bottom of the vehicle by the increased heights of the walls of the non-crushable concrete base.

In a preferred form of this embodiment, the front end of the concrete base is at a height of about six inches or less. At a distance of about three feet along the base, the sides of the concrete base step upward forming walls to the channel portion of the concrete base. The initial step is approximately three inches; thus, the wall to the channel portion is at a height of about three inches while the total height of the concrete base is about nine inches. At about six feet further along the concrete base, another approximately three inch step occurs raising the height of the wall of the channel portion to about six inches with the total height of the base being about one foot. The remaining approximately 12 feet of the concrete base is at this height of about one foot with a channel wall height of about six inches.

In further accordance with this embodiment, side runners are attached to the exterior walls of the concrete base at the point when the wall height is at its maximum. These side runners are capable of producing redirection of vehicles that collide with the concrete base at an angle along the side. It is also contemplated that the side runners be molded or formed as an integral part of the walls which would also perform the same function of redirecting errant vehicles.

The modules of this embodiment are designed as rectangular sections and are of a width smaller than the width of the channel portion and thus capable of being inserted within the channel portion of the concrete base. The height and length of the modules are variable. In a preferred form this embodiment the modules have dimensions of about 11 inches in width, about three feet in length and about two feet in height. The 11 inch width makes for easy insertion into the one foot wide channel portion of the concrete base.

The modules may be composed of three layers of crushable material. High strength material forms the bottom portion of the module. An intermediate portion of lower strength material is attached to and is above the bottom portion and an upper portion of medium strength material is attached to the intermediate portion. In a preferred form of this embodiment, the bottom or lower 10%–15% of the module is composed of about 1000 psi material, the next 40%–50% of the module is about 70 psi material and the top 40%–50% of the module is about 100 psi material.

The higher strength material in the bottom of the module is designed to secure reinforcement and beam connectors, the function and orientation of which is described below. The relatively soft layer (the intermediate layer) of material above the high strength material, together with the top layer which is at least 35% stronger than the intermediate layer act to keep an impacting vehicle down and prevent ramping even when the upward steps in the wall of the concrete base referred to above are encountered.

In this embodiment of the invention, two types of modules are contemplated. Both types of modules have substantially identical compositions of concrete or crushable material, each having three layers as described above. The difference in the modules lies in the type of reinforcement provided within the module and the means provided for attaching the modules to the concrete base.

In most forms of this embodiment, there will be at least one module of the first type (Type A) and one module of the second type (Type B). A barrier wall requiring only two modules, one of each type, would be suitable for areas where a low velocity of the impacting vehicle is anticipated. Where greater velocities are anticipated or where, for some other reason, a longer barrier wall is desired, the concrete base is lengthened and more modules of type A are provided to fill in the increased length of the concrete base.

In most forms of this embodiment, there is usually only one module of type B. The type B module is positioned at the end of the linear array of type A modules and is at the end of the concrete base and is immediately adjacent the roadside obstacle or PCB. Means are provided for both modules to be attached to the concrete base.

In Type A modules, a plurality of S-beam or other wide flange beam sections are imbedded in the bottom of the module linearly aligned with the center axis of the module such that the bottom flange of the beam protrudes from the lower surface of module. One beam section is imbedded in this manner at either end of the module. Two circular bars are overlain on the upper flange of the beam sections within the module to connect them and strengthen their alignment.

The means of attaching the concrete module of type A to the structural concrete base comprise two steel beams, in the nature of an S-beam or other wide-flange beam section, embedded in the channel portion of the base, symmetrically arranged on each side of the center axis of the base, with the upper flanges of the beams being flush with the bottom of the channel portion, the beam web being perpendicular to the plane of the channel portion, and the beams being separated from each other sufficient to provide a space to receive the web portion of a similar type beam protruding from the lower surface of the module of type A as described above.

The protruding S-beams in the type A modules allow for easy attachment to the concrete base by inserting them between the space provided by the two beams embedded within the channel portion of the base and positioning the module at the desired location along the length of the concrete base.

The Type A modules may be reinforced by a wire mesh or poultry mesh in combination with reinforcing steel which surrounds the wire mesh.

The means for attaching the type B modules to the concrete base may be in the nature of two dowels inserted through holes, drilled through the outside walls of the base and through the bottom portion of the module.

The Type B module has embedded entirely within it reinforcement capable of also acting to cause an impacting vehicle to rise up to avoid impacting the blunt end of a roadside obstacle or PCB if the impacting vehicle has progressively crushed all type A modules and has arrived at the last module (of type B) in the linear array of modules on the concrete barrier.

In a preferred form of this embodiment, the reinforcement is in the nature of steel pipe and beam triangle reinforcement. An S-beam or other wide flange beam is completely embedded within the module in the lower portion thereof. Thus, the two dowel holes referred to above which are drilled through the concrete base walls and module also pass through the web section of this beam. on top of the beam is formed a triangle made of steel pipe. The triangle has a vertical leg protruding from the top flange of the beam at the end proximate the roadside obstacle of the module, and a hypotenuse angling downward from the vertical leg to join the other end of the beam. All the connections in this beam/pipe orientation are welded. This triangular reinforcement is designed to cause a vehicle to climb vertically to miss the front of the first PCB segment if a vehicle ever penetrated beyond all the type A modules.

Therefore, in accordance with the present invention, a vehicle impacting the roadside barrier in a "head-on" configuration will be brought to a stop safely before it encounters the end of the concrete barrier wall. Further, the action of the vehicle crushing the lower density crushable material will act to restrain the vehicle from being launched over the roadside barrier into opposing lanes of traffic.

Finally, in accordance with the present invention, the lower density crushable material used at the top of each of the barrier wall sections of the first embodiment, or of the module sections of the second embodiment will be of sufficient strength to enable the roadside barrier according to the present invention to act in a manner similar to a conventional concrete barrier wall to deflect vehicles impacting the roadside barrier at acute angles. In addition, the side runners mounted on or molded as part of the exterior wall portion of the concrete base of the second embodiment also acts to deflect vehicles impacting the roadside barrier.

BRIEF DESCRIPTION OF THE DRAWINGS

FIG. 5 is a cross-sectional view of the end of the module depicted in FIG. 2.

FIG. 6 another cross-sectional view of the end of the module depicted in FIG. 2

FIG. 7 is a cross-sectional view taken through the final section of the module depicted in FIG. 2.

FIG. 8 is a cross-sectional view of an intermediate section of the module depicted in FIG. 2.

FIG. 9 is a plan view showing an embodiment of the present invention protecting the end of a concrete barrier wall.

FIG. 10 is a plan view of an alternate arrangement of embodiments of the present invention.

FIG. 11 is a plan view o yet another alternate arrangement of embodiments of the present invention.

FIG. 13 is a detailed side view of a second preferred embodiment of the advanced dynamic extension module according to the present invention.

FIG. 16 is a rear view of a second preferred embodiment of the advanced dynamic extension module according to the present invention.

FIG. 17 is a perspective view of a module of a first type of a second preferred embodiment showing a suitable beam section and steel bar reinforcement.

FIG. 18 is a perspective view showing a suitable orientation of wire mesh reinforcement within the module of the fist type of a second preferred embodiment.

FIG. 19 shows an end view of th wire mesh and steel bar reinforcement within the module of the first type of a second preferred embodiment.

FIG. 20 is an exploded perspective view of a portion of the advanced dynamic extension module according to a second embodiment of the preferred invention showing how the modules are slidably insertable into the structural concrete base.

FIG. 21 is a module of a second type of the second preferred embodiment showing the S-Beam and structural steel arranged in triangular fashion.

DETAILED DESCRIPTION OF THE PREFERRED EMBODIMENTS

Figure 2:
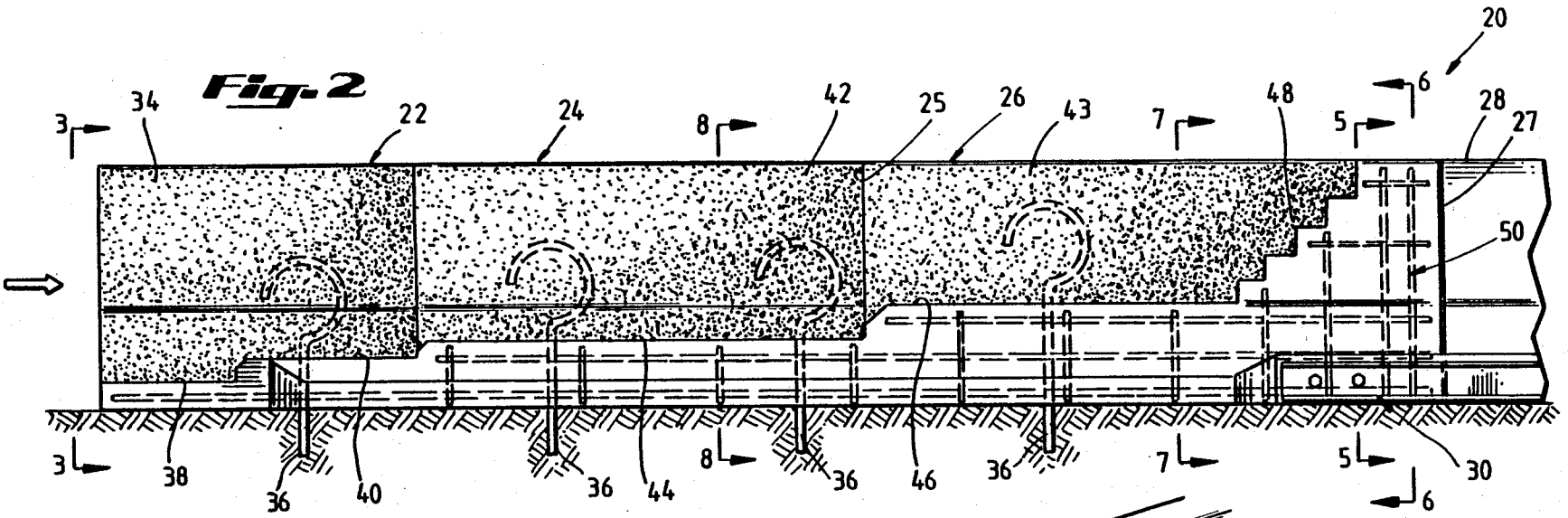
FIG. 2 is a detailed side view of a preferred embodiment of the advanced dynamic extension module according to the present invention.
Figure 3:
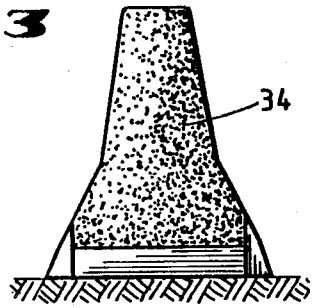
FIG. 3 is a cross-sectional view of an intermediate section of the advanced dynamic impact extension module depicted in FIG. 2.

Referring to FIG. 2, a preferred embodiment of an advanced dynamic impact extension module, or roadside barrier, according to the present invention is shown. In this embodiment, a plurality of linearly arrayed barrier wall sections, denoted as 22, 24 and 26 are positioned immediately in front of an end 27 of a concrete barrier wall 28. Referring now to FIG. 3, which is a view taken along section 3 of FIG. 2, it is shown that the several sections of the roadside barrier according to the present invention have a substantially identical cross-sectional configurations, which in turn are substantially identical to the cross-sectional configuration of the concrete barrier wall 28.

Referring again to FIG. 2, in accordance with this embodiment of the present invention, a first section 22 is a composite section comprised of a reinforced concrete portion 38 and 40 and a lower density, crushable material portion 34. The lower density, crushable material portion 34 is positioned above the reinforced concrete surfaces 38 and 40. In this embodiment of the invention, the lower density, crushable material 34 positioned above the reinforced concrete surfaces 38 and 40 will comprise at least two-thirds of the cross-sectional volume of the first section.

Referring still to FIG. 2, the roadside barrier 20 according to the present invention will be provided with at least one intermediate section 24. The intermediate sections 24 are also composite sections wherein a lower portion 44 of each section 24 is comprised of reinforced concrete while an upper portion of 42 of each section is comprised of lower density, crushable material. Each intermediate section 24 is further characterized in that sections located near the first section 22 of a roadside barrier are comprised of a greater volume of low density, crushable material 42 than are the sections positioned closer to the end 27 of the concrete barrier wall 28 which the roadside barrier 20 protects.

In this manner, the composition, and hence the proportion, of crushable material to reinforced concrete varies in each intermediate section 24 so that the intermediate sections 24 are comprised of a progressively lesser volume of low density, crushable material 42 as the linear distance from the first section 22 to each intermediate section 24 increases. In accordance with the present invention, the low density, crushable material 34 of the first section and the low density, crushable material 42 of each intermediate section is bonded to the reinforced concrete base of each section.

Referring still to FIG. 2, in an alternate embodiment of the present invention, reinforcing steel 36 is formed in the reinforced concrete sections 38, 40 and 44 so that a hooked portion of the reinforcing steel extends upwardly beyond the upper surface 38, 40 and 44 of the reinforced concrete. Thereafter, when the lower density, crushable material is formed in place on top of the reinforced concrete and is attached to the reinforced concrete, the lower density, crushable material will be further supported by the reinforcing steel 36, attached to the reinforced concrete.

Referring still to FIG. 2, the roadside barrier 20 is further provided with a final barrier section 26. Final barrier section 26 has a front end 25, positioned toward the intermediate barrier sections 24 and a back end 48 positioned linearly, distally from the first section. In a most preferred embodiment of the present invention, the reinforced concrete 46 provided along the base of the final roadside barrier section 26 will increase rapidly in a stepped configuration through the longitudinal width of the final section 26 as depicted in FIG. 2 at numeral 48. Therefore, a vehicle passing through the first section 22 and all intermediate sections 24 will finally encounter the final roadside barrier section 26, the front end of the vehicle coming to rest at the rear, stepped portion 48 of the final barrier section 26.

In this embodiment of the present invention, the cross-sectional volume of the front end 25 of the final section 26 is comprised of approximately half reinforced concrete 46, positioned along the bottom of the section 26, and half low density, crushable material 43 placed above, and on top of, the surface of the reinforced concrete base 46 of the final section 26. As depicted in FIG. 2, the final roadside barrier section 26 will, at its back end 48, be comprised entirely of reinforced concrete. This further enables the roadside barrier 20 to be fixedly attached to the welding end 27 of a concrete barrier wall 28.

Figure 4:
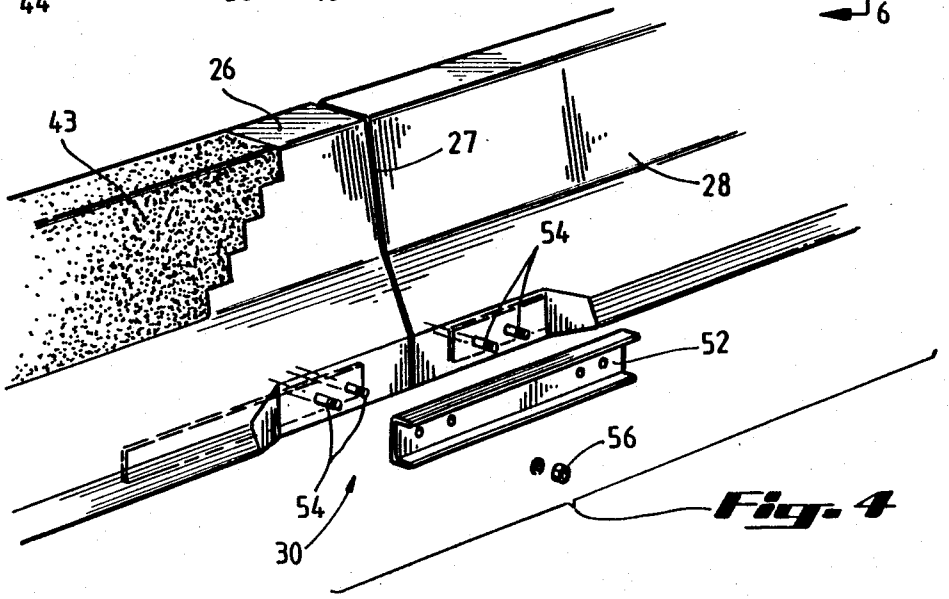
FIG. 4 is a perspective view of a final section of the advanced dynamic impact extension module depicted in FIG. 2 showing it attached to the end of the concrete barrier wall which it protects.

Referring to FIG. 4, a partially exploded perspective view of the final section 26 and the end 27 of a concrete barrier wall 2 is shown. As noted at 30 in FIG. 4 (and at numeral 30 in FIG. 2) the final section 26 of the roadside barrier 20 is preferably fixedly attached to the end 27 of a concrete barrier ball 28. In the embodiment shown, a channel-shaped splicing member 52, is provided with apertures to receive lag bolts 54 formed in the reinforced concrete of both the final section 26 of the roadside barrier, and the concrete barrier wall 28. In this embodiment, fasteners 56 are applied to the lag bolts 54 to secure a channel-shaped member 52 to the roadside barrier and to the concrete barrier wall. IN a preferred embodiment of the present invention, each individual section of the advanced dynamic impact extension module 20 are also joined together, and may be so joined in a manner similar to the method used to join the module 20 the concrete barrier wall 28 (as indicated in FIG. 4).

Referring now to FIGS. 1A through 1D, the individual sections 22, 24, and 26 of a roadside barrier 20 according to the present invention are arranged in a linear array so that a vehicle 10 impacting the first section 22 in a "head-on" direction will encounter, in ascending order, a step-wise array of lower, reinforced concrete base sections as the vehicle crushes the crushable material above each reinforced concrete based portion of each section. As shown specifically in FIGS. 1C and 1D, the raised, stepped array of reinforced concrete bases of the individual barrier sections according to the present invention will coact with the undercarriage of the vehicle 10 to further impede the forward progress of the vehicle 10 as the vehicle 10 moves through the barrier 20. According to the present invention, the combined effect of the force exerted by the front of the vehicle 12 in crushing the crushable, low density material of each section, with the force expended by the vehicle 10 as the undercarriage of the vehicle 10 encounters drag caused by the raised stepped reinforced concrete portions of the individual barrier sections, coact to bring the vehicle 10 t a stop before the vehicle 10 encounters the end 27 of the concrete barrier wall 28.

Referring again to FIG. 2, in a most preferred embodiment of the present invention, the density of the lower density, crushable material 34 in the first section 22 is less than the density of the lower density, crushable material 42 located in each intermediate section 24. In a similar manner, the density of the crushable material 42 provided in each intermediate section 24 increases as the distance from each individual intermediate section 24 to the first barrier section 22 increases. Finally, the density of the lower density, crushable material 43 provided in the final barrier section 26 is greater than the density of any of the material used in the lower density, crushable portions of the intermediate sections 24.

However, it is a preferred function of the roadside barrier 20 according to the present invention that the lower density, crushable material used in each of the barrier sections 22, 24, and 26 be of sufficient strength to deflect a glancing impact from a vehicle impacting the sidewall surfaces of the barrier at an acute angle.

Referring now to FIG. 8, a cross-sectional view of an intermediate section 24 of a roadway barrier according to the present invention is depicted. As shown, the composite highway lane barrier section 24 is composite lane barrier having a lower, substantially non-crushable base component 44 and an upper crushable top component 42. In this embodiment of the present invention, the lower substantially non-crushable base component 44 may be comprised of reinforced concrete wherein the reinforcing rods are shown at 60 and 64. In this embodiment of the present invention, the highway lane barrier rests atop the shoulder of the roadway 32, or may be conveniently placed immediately adjacent, and parallel to, the roadway.

Referring again to FIG. 2, the base component (shown at 38, 40, 44, and 46) is configured to increase in height from a front end of the barrier (shown in cross-section in FIG. 3) to a back end 48 of the barrier 20 position proximate to a leading end 27 of a conventional highway lane barrier 28. The back end 48 of the barrier 20 according to the present invention is further configured to abut the leading end 27 of the conventional concrete lane barrier 28.

In this embodiment, the upper component (denoted as 34, 42, and 42 in FIG. 2) rests upon, and is attached to, the individual base components of the barrier.

Figure 1A:
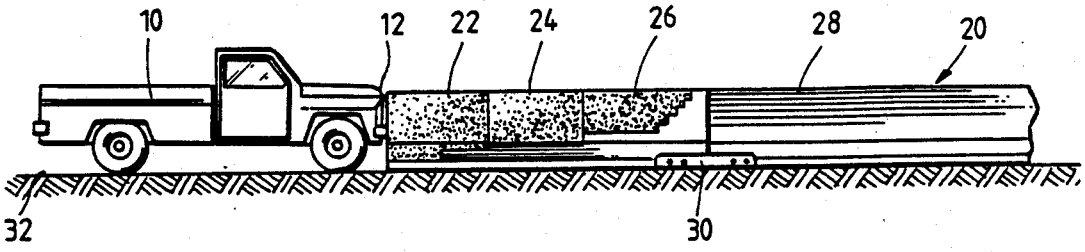
FIG. 1A is a side view depicting a vehicle which is about to impact a roadside barrier according to the present invention in a "head-on" direction.
Figure 1B:
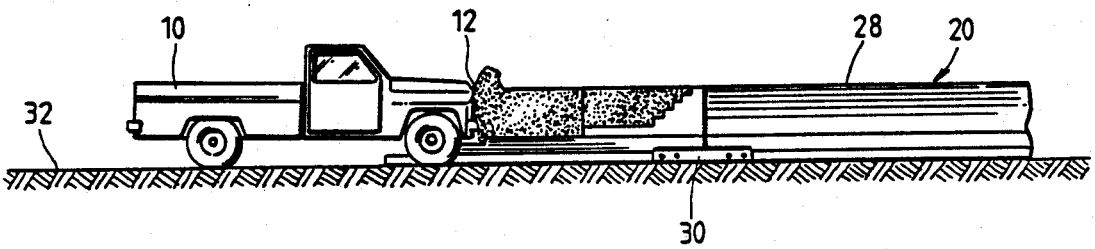
FIG. 1B is a view of the vehicle depicted in FIG. 1A which has impacted a roadside barrier according to the present invention and has crushed the lower density material positioned in a first composite section of the barrier.
Figure 1C:
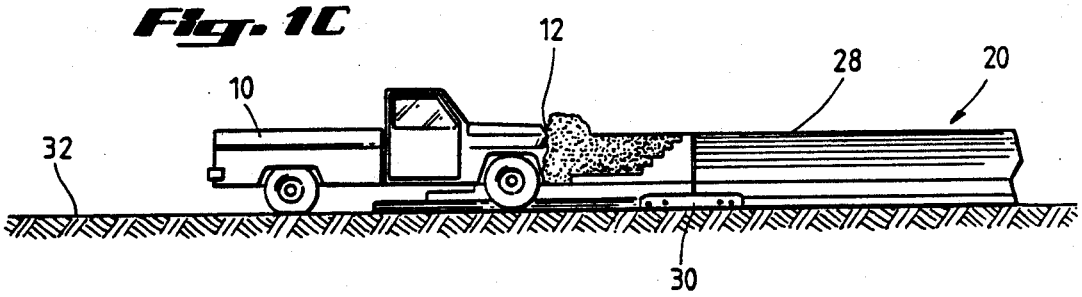
FIG. 1C is a side view of the vehicle depicted in FIG. 1A and 1B wherein the vehicle has passed through a first composite section of a roadside barrier according to the present invention. The velocity of the vehicle in FIG. 1C is being reduced by the force required to crush the lower density, crushable material positioned in the upper portion of the intermediate section, while the velocity of the vehicle is further reduced by the coaction of the raised, reinforced concrete portion of the intermediate sections of the barrier with the undercarriage of the vehicle.
Figure 1D:
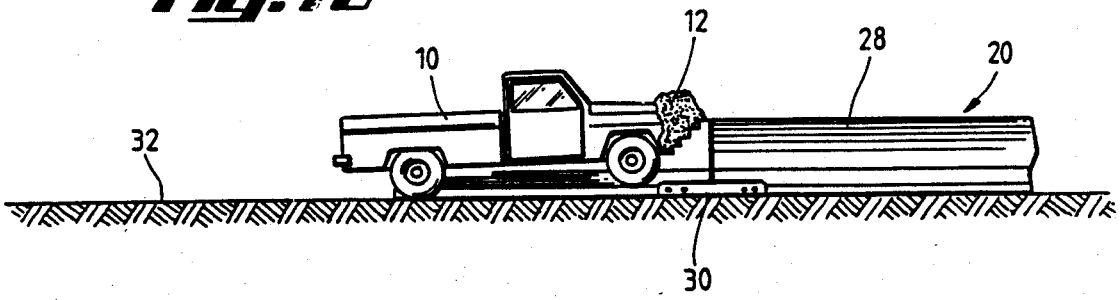
FIG. 1D is a side view of the vehicle depicted in FIGS. 1A through 1C wherein the vehicle has passed through the first composite section, and all of the intermediate sections and has finally been brought to rest before it encounters the end of the concrete barrier wall.

In a preferred embodiment of the present invention, and as shown specifically in FIGS. 2 and 3, the height of the base component 38 of the barrier 20 at the front end of the first section 22 of the barrier is less than the road clearance of a vehicle impacting the barrier in a "head-on" direction. Roadway clearance may be defined as the vertical distance from the surface of the road to the undercarriage of a vehicle. This relationship is also clearly shown in FIG. 1B wherein a vehicle 10 is shown after impacting a barrier 20 and crushing the crushable material positioned over the base component 38 of the first section 22 of the barrier 20. In FIG. 1B, it is shown that the undercarriage of the vehicle 10 is able to clear the base component 38 of the first section 22 of the barrier 20.

In further accordance with the present invention, the height of base components 44, 46, and 48 of the intermediate sections of the barrier is greater than the road clearance of a vehicle 10 impacting the barrier. This is further shown specifically in FIGS. 1C and 1D where the undercarriage of a vehicle 10 is shown coacting with the base components to create friction and drag between the base portions and the vehicle to further impede the forward progress of the vehicle 10 as it moves through the barrier.

In a preferred embodiment of the present invention, and as shown specifically in FIGS. 2, 3, and 5-8, the height of the base components of the barrier 20 increases in step-wise fashion from the front end of the barrier (section 22) to the back end of the barrier (section 26) as shown at 48. In this embodiment of the present invention, a plurality of intermediate sections 24 may also be provided between, and along the length of the barrier 20. These intermediate sections 24 interconnect the front section 22 with the back section 26 of the barrier. The intermediate sections 24 may further be characterized by variable density crushable top components from the front 22 of the barrier 20 to the back 48 of the barrier so that the crushable top components of the barrier crush under the influence of lesser impacting force near the front of the barrier while the crushable top components positioned near the back 48 of the barrier require significantly greater impacting force in order to be crushed. Therefore, the density of the crushable top components of the intermediate sections 24 also increases in step-wise fashion from the front of the barrier to the back of the barrier.

Referring to FIG. 9, a planar view of an array of roadside barriers 66 according to the present invention is shown. In this application of the present invention, roadway barriers 66 according to the present invention are shown positioned between parallel lanes of traffic flow denoted by the arrows. In this configuration, roadside barriers, or advanced dynamic impact extension modules 66 are placed on either side of, and in front of, and end 27 of a conventional concrete barrier wall 28. With this configuration, any vehicle, travelling in the direction denoted by an arrow, which strays from the roadway toward the end 27 of the concrete barrier wall 28, will encounter at least one module 66 which will prohibit the vehicle from impacting the end 27 of the concrete barrier wall 28 and will saftey slow the vehicle without causing injury to the vehicle's occupants.

In a similar manner, FIG. 10 depicts an arrangement whereby a plurality of impact modules 66 may be arranged to protect opposed ends 27 of a concrete barrier wall 28. As shown in FIG. 10, when a concrete barrier wall 28 is used to divide opposing lanes of traffic (again as indicated by the arrows) impact modules 66 may be placed before each end 27 of the concrete barrier wall 28. Further, in this arrangement of embodiments according to the present invention, additional impact modules 66 will be placed parallel to the concrete barrier wall ends, adjacent the concrete barrier wall in a direction toward the direction of traffic. Therefore, the modules 66 protect a vehicle from by-passing the impact module 66 positioned before the end 27 of the concrete barrier wall. IN this arrangement of modules embodying the present invention, the adjacently placed module 66 are positioned slightly behind the leading edge 80 of the module 66 attached to the concrete barrier wall 28 in order to provide increased vehicle protection.

FIG. 11 depicts an alternate arrangement of an advanced dynamic impact extension module 66 according to the present invention.

Figure 12:
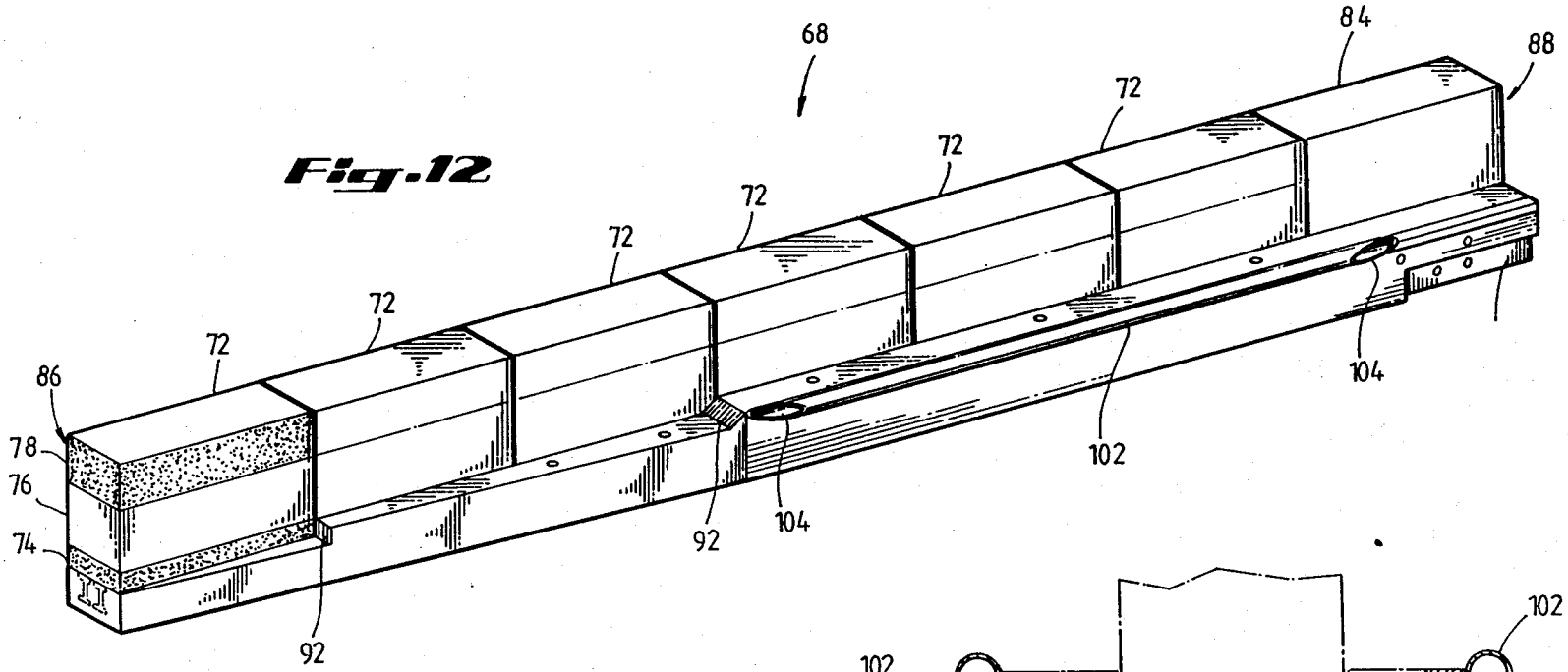
FIG. 12 is a perspective view of a complete advance dynamic impact extension module of a second preferred embodiment.

Referring to FIG. 12 a second preferred embodiment of an advanced dynamic impact extension module, or roadside barrier 68, according to the present invention is shown. In this embodiment, a structural concrete base, denoted as 70, is positionable immediately in front of a concrete barrier wall (not shown). In FIG. 12, it is seen that a series of module sections 72 and 84 are arranged in linear fashion atop the structural concrete base. These module sections are each of substantially identical cross-sectional configurations, and are generally in rectangular shape. The modules are slidably insertable within a channel of the structural concrete base.

Referring again to FIG. 12, and also to FIG. 17, in accordance with the second preferred embodiment of the present invention, a plurality of modules of a first type 72 are provided which are composite sections comprising reinforced concrete portion 74 and two layers of crushable concrete material 76 and 78. The bottom portion 74 of module 72 is about 10%–15% of the total height of the module and is composed of semi-crushable, higher density material. A center portion 76 of module 72, being 40%–50% of the total height of the module, is composed of low density crushable material which is on the order of 70 psi. The top portion 78 of module 72, being 40%–50% of the total height of the module is composed of crushable material 35%–45% stronger than the low strength material of the intermediate layer 76. In this embodiment of the invention, the higher density material 74 positioned in the lower portion of modules 72 is adaptable to secure S-Beam or other wide flange beam sections 80, the upper flange and substantially all of the web portion of which are embedded within said module sections 72, but the bottom flange portion 82 of the S-Beam, protruding slightly below the lower surface of modules 72. The other two layers 76 and 78 coact to keep an impacting vehicle down and to prevent ramping of an impacting vehicle.

Referring still to FIG. 12, the roadside barrier 68 according to the present invention is provided with a module of a second type 84. The module of the second type 84 is positioned at the end of the linear array of the plurality of modules of the first type 72 and is positionable immediately adjacent a roadside obstacle. The module 84 is a composite section comprising the same orientation of concrete or crushable material as in the modules of the first type 72. Therefore, module 84 also has a lower portion 74 of semi-crushable higher density material, an intermediate portion 76 of low density material and an upper portion 78. The modules of both the first type 72 and the second type 84 according to the present invention are arranged in a linear array so that a vehicle impacting the front end portion of the barrier wall 68 in a head-on direction will encounter in successive fashion each of the modules, crushing first the purality of modules of the first type 72 and finally reaching the module of the second type 84.

Referring still to FIG. 12 and also to FIG. 13, it is seen that the concrete base portion 70 of the barrier wall increases in step-wise fashion, stepping upward at defined intervals beginning from the front end 86 of the structural concrete base 70 toward a back end 88 immediately adjacent a roadside obstacle. As shown in a preferred form of this embodiment, the height of the concrete base at the front end of the barrier wall is about three to six inches. At a distance of about three feet along the base, the sides of the concrete base section step upward beginning the formation of walls 92 to a channel 90 of the concrete base. The initial step is approximately three inches in height; thus the wall 92 to the channel 90 at this point is at a height of about three inches while the total height of the concrete base is about nine inches. At six feet further along the concrete base 80, being a total of about nine feet from the front end 86 of the barrier wall 68, another three inch step increase occurs raising the height of the wall 92 of the channel to six inches with the total height of the concrete base 70 being one foot or more. The elevation for the remaining 12 feet of the concrete base is at this height of one foot or more with the channel wall 92 height being about six inches. The increase in elevation may also be due to a gradual sloped increase beginning at the front of the base proceeding toward to back end.

This stepped or sloped increase in the elevation of the structural concrete base 70 according to the present invention will coact with the undercarriage of an impacting vehicle to further impede the forward progress of the vehicle as the vehicle moves through the roadside barrier 68. According to the present invention, the combined effect of the resistance exerted by the crushable portions of the module sections 72 and 84 acting against the front and of an impacting vehicle, together with the resistance exerted by the coaction of the undercarriage of an impacting vehicle as it encounters drag caused by the raised stepped or sloped elevation of the structural concrete base 70, result in the vehicle coming to a stop before the vehicle encounters the end portion of the concrete barrier wall or roadside obstacle.

Referring still to FIG. 13, a section 94 of the lower back end portion of the concrete base is adapted to be fixably attached to the end of a concrete barrier wall as shown in FIG. 4.

Figure 14:
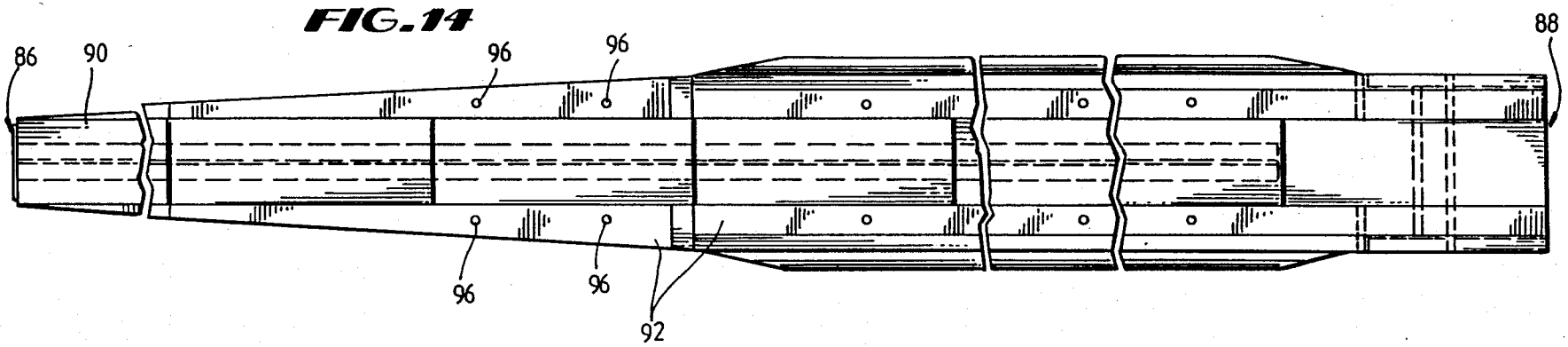
FIG. 14 is a detailed plan view of a second preferred embodiment of the advanced dynamic extension module according to the present invention.

Referring still to FIG. 13, and also to FIG. 14 which shows a plan view of the barrier wall, the roadside barrier according to the present invention will be provided with vertical dowel holes 96 placed at locations in the walls 92 of the channel 90 of the concrete base 70 through which anchoring dowels will be inserted to secure the structural concrete base 70 to a roadway surface.

Figure 22:
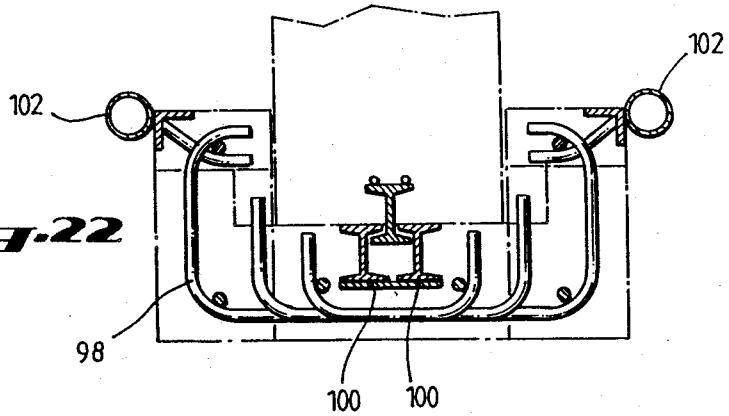
FIG. 22 shows an exploded and exposed front view of the advanced dynamic extension module detailing an exemplary orientation of reinforcement provided within the structural concrete base.

Referring now to FIG. 22, therein is depicted a detailed view of the front end 86 of the structural concrete base 70 showing a possible orientation of structural reinforcement 98 of the concrete base 70. Embedded within the channel 90 of the structural concrete base 70 are two S-beams or other wide flange beams 100, symmetrically arranged on each side of the center axis of the concrete base, with the upper flange of the beams 100 being flush with the bottom of the channel portion 90, the beam web being perpendicular to the plane of the channel 90 and the beams being separated from each other by a space sufficient to receive the web and flange portion of a corresponding beam section protruding from the bottom face of the type A modules.

In a preferred form of this embodiment these two beams 100 run a distance of about 18 feet beginning at the front end 86 of the structural concrete base 70 and terminating about three feet from the back end 88 of the structural concrete base 70. The beam sections 80 which were embedded in the modules of the first type 72 are slidably insertable in the space provided by the beams 100 embedded within the channel 90 of the structural concrete base 70.

FIG. 20 shows an exploded cross-sectional view of the manner of slidably inserting the modules of the first type 72 between the beams 100 embedded within the channel 90 of the concrete base 70.

Referring gain to FIG. 22, therein is shown the attachment of a longitudinal member 102 in the nature of a pipe side runner, attachable to the wall portion 92 of the concrete barrier 68 at a point where the wall portion 92 is at its maximum height. The side runner can also be molded or formed as an integral part of the wall itself. In the preferred form of this embodiment the longitudinal member 102 begins at a point about nine feet from the front end 86 of the roadside barrier 68 and continuing thereafter for about 10 feet. The ends 104 of the pipe side runner are cut diagonally so as to lessen the area of a blunt end which could damage an impacting vehicle. The longitudinal member 102 is suitable for redirecting a vehicle impacting at an acute angle back into a lane of traffic.

Referring now to FIG. 17, therein is depicted a module of the first type 72 showing the beam sections 80 which are slidably insertable into the beams 100 embedded within the channel 90 of the structural concrete base 70. In further accordance with the present invention, connecting members 106 are overlain on the top flanges of the beam sections 80 in such a manner as to connect the two sections 80 and to strengthen their alignment.

Referring now to FIG. 18, therein is depicted a type of wire mesh reinforcement 108 capable of being embedded within the module of the first type 72 and adapted to provide reinforcing strength to said module.

FIG. 19 is an end view showing the orientation of the wire mesh 108. Surrounding the wire mesh in generally rectangular shape is reinforcing steel or wire 110 adapted to reinforce the module 72 and maintain the orientation of the wire mesh 108.

Figure 15:
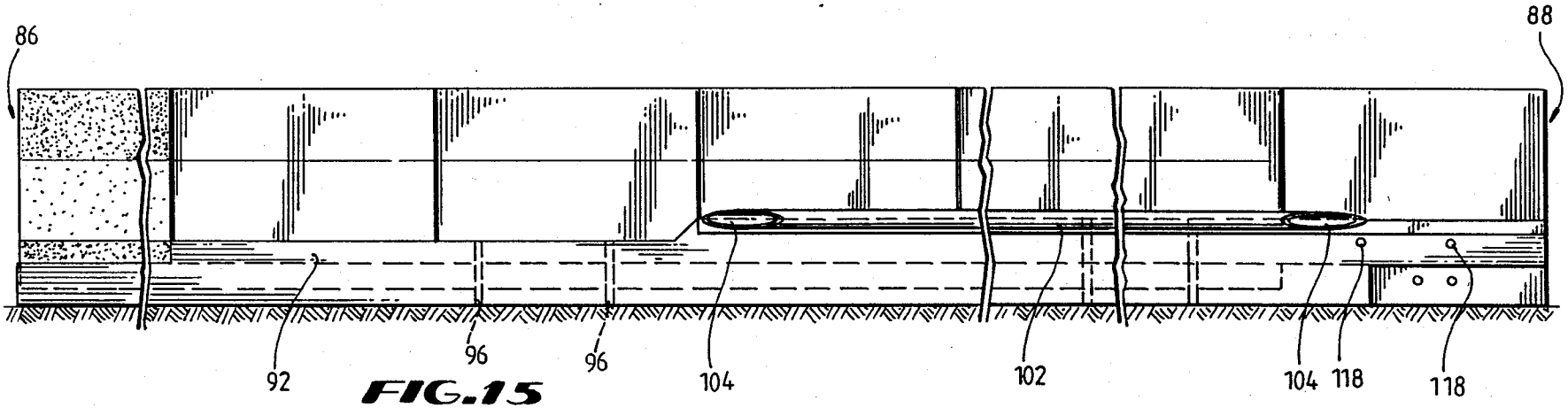
FIG. 15 is a detailed front view of the advanced dynamic extension module according to a second preferred embodiment of he present invention.

FIG. 15 depicts a front view similar to that shown in FIG. 22 of the structural concrete base 70 with the modules 72 sitting atop thereof. FIG. 16 depicts a rear view of the barrier wall 68 showing the modules of the second type 84 sitting within the channel 90 of the concrete base 70. The module of the second type 84 has embedded entirely within it a steel pipe and beam triangle reinforcement. As shown in FIG. 21, a beam 112 is completely embedded within the module of the second type 84 and forms the horizontal leg of a right triangle. The vertical leg of the right triangle is formed by the reinforcing member 114 extending vertically upward almost the entire height of the module 84, and hypotenuse 116 angling downward from the vertical leg 114 to join the opposite end of the beam 112.

The triangular steel pipe and beam reinforcement of FIG. 21 is provided so that if a vehicle is traveling at sufficient velocity such that it passes through the plurality of modules of the first type 72, it will finally encounter the final module 84 which is of the second type. The triangular reinforcement in module 84 will cause the front end of the vehicle to rise upwardly to avoid impacting the concrete barrier segment to which this embodiment of the invention is attached.

Referring again to FIG. 16, the module 84 of this second preferred embodiment may be attachable to the structural concrete base 70 by means of dowels inserted through dowel holes 118 drilled through the concrete base walls 92 and passing through the web section of the beam 112. Two such dowel holes 118 are provided along the length of the module of the second type.

Referring again to FIG. 17, in this preferred embodiment of the present invention, the density of the lower portion 74 of the modules 72 and 84 is substantially greater than the density of the intermediate 76 2nd upper 78 sections of the modules 72 and 84. The greater density material 74 is of sufficient strength to secure the beam sections 80 embedded in the modules 72 and to secure the beam 112 entirely embedded within the module 84. The intermediate section 76 is of less dense material than the upper most section 78 and both sections 76 and 78 are substantially less dense than section 74. The intermediate section 76 and upper most section 78 are adaptable to prevent an impacting vehicle from ramping with the upper most layer 78 being of sufficient strength to actually hold down a vehicle and prevent it from rising faster than the stepped or sloped increase in the elevation of the concrete barrier section 70 would provide.

Various modifications and improvement may be made to the disclosed embodiments of the present invention without departing from the overall scope and spirit of the invention. For example, various materials may be used for the lower density, crushable material such as low strength, porous concrete; styrofoam; or plastics. Further, the cross-sectional configuration of the roadside barrier itself may be varied in order to accommodate various barrier wall configurations, or to provide increased vehicle protection in areas of high traffic density and high traffic speed. In this respect, the first eight to twenty feet of the barrier module may be provided with a cross section that is different than the remaining portion of the barrier module, or the concrete barrier wall itself.

What is claimed is:

1. A roadside barrier, adapted to prevent vehicles from impacting an obstacle, comprising;

a structural concrete base section adaptable at its upper surface to receive rectangularly shaped crushable modules; wherein said base section defines a channel along the upper surface of said base and wherein said rectangular modules are received within said channel and are arranged end-to-end;

a first type of said module comprising a composite module comprising three layers of crushable material of varying strengths; wherein the lowest layer comprises a higher strength material, an intermediate layer immediately above said lowest layer comprising a low strength material, and an uppermost layer comprising material having a strength above said low strength material and weaker than said high strength material; and a second type of module comprising a composite module comprising three layers of crushable material of varying strengths substantially the same as said first module type; said second module type positionable at the end of a linear array of modules of said first type at the end of said structural concrete base immediately adjacent said roadside obstacle; and wherein the structural reinforcement within said module is characterized by ability to impart upward movement to an impacting vehicle; and means for fixedly attaching said modules of the first type and means for fixedly attaching said modules of the second type to said base.

2. The barrier according to claim 1, wherein the modules of the first type are arranged linearly so that a module of the first type is positioned at a front end of said concrete base closest to a path of oncoming vehicles with a linear array of such modules extending in a line away from said first module toward said module of said second type and said roadside obstacle, in a direction parallel to a line depicting the flow of oncoming vehicles.

3. The barrier according to claim 1 wherein said structural concrete base is positioned linearly having a front end of said base positioned closest to oncoming vehicles and a pack end adjacent said roadside obstacle; wherein the width of the base near said front end has an outward taper toward the back end; and wherein the width of the base remains constant up towards the back end of said base.

4. The barrier according to claim 1 wherein the elevation of said structural concrete base increases in a stepwise fashion along its length such that walls are formed upward from the channel of the concrete base.

5. The barrier according to claim 1 wherein the elevation of said structural concrete base increases in a gradual sloping fashion along its length beginning at said front end such that walls are formed upward from the channel of the concrete base.

6. The barrier according to claim 1 wherein two S-beams or other wide flange sections are embedded in the structural concrete base with the upper flanges of said beams being flush with the floor of said channel of said structural concrete base and running parallel to the longitudinal axis of the structural concrete base beginning at the front end of said concrete base and running toward the back end.

7. The barrier according to claim 1 or claim 6 wherein each module of the first type has embedded therein and protruding from the bottom portion thereof two separate beam sections positioned at each end of said module so as to be slidably insertable between the two said beams embedded within said channel of said structural concrete base, and wherein two reinforcing members overlie and are connected to the top flange of said beam sections and are embedded entirely within said modules, to strengthen the alignment of said beam sections.

8. The barrier according to claim 4 or claim 5 wherein said walls to said channel and each module of the second type includes matching dowel holes adaptable to receive dowels to secure said module of the second type into place on the channel portion of said concrete base.

9. The barrier according to claim 4 or claim 5 wherein dowel holes are provided in said channel walls adaptable to receive dowels to secure said base on a roadway surface.

10. The barrier according to claim 4 or claim 5 wherein longitudinal side runners are attached to the sides of the walls of the concrete base; and are configured to produce redirection of vehicles that collide with said barrier at an angle along the side.

11. The barrier according to claim 4 or claim 5 wherein longitudinal side runners are integrally molded or formed as part of the wall portion of the concrete base which are configured to produce redirection of vehicles that collide with said barrier at an angle along the side.

12. The barrier according to claim 1 wherein all said modules of the first type include tubular wire mesh reinforcement, the longitudinal axis of said tubular wire mesh being oriented parallel to the longitudinal axis of said module sections, and further including reinforcing steel surrounding the wire mesh and generally paralleling the sides of said rectangular modules.

13. The barrier according to claim 1 wherein said module of the second type includes a triangular steel pipe and beam reinforcement, wherein an S-beam or other wide flange section is completely embedded within said module in the lower portion thereof and runs substantially the entire length thereof, and wherein steel pipe reinforcement extends upward from the upper surface of said beam and then angles downwardly to rejoin the beam, said triangular arrangement being configured to cause an impacting vehicle to climb vertically to miss the front end of a roadside obstacle 14. A composite, highway lane barrier for use at the leading end of a conventional concrete highway lane barrier, comprising:

an elongated composite lane barrier comprising a lower, substantially non-crushable structural concrete base component and a channel along its upper surface, and modules of crushable concrete of varying strengths receivable within said channel;

pipe side runners attached to or integrally formed as part of the walls of said channel and adapted to deflect a vehicle impacting said barrier at an acute angle into a lane of traffic adjacent said composite structure;

said structural concrete base component of said barrier being configured to increase in height from the front end of said barrier to the back end of said barrier.

15. A roadside barrier member, comprising:

a generally rectangular, crushable, multi-layer module, including:

a semi-crushable, higher strength, bottom layer;

a crushable, low strength, intermediate layer above and secured to the bottom layer; and a crushable, intermediate strength, top layer above and secured to the intermediate layer.

16. The barrier member of claim 15 in which each layer comprises concrete.

17. The barrier member of claim 16, further comprising:

an S-beam or similar wide flange beam embedded in the bottom of the bottom layer with the lower flange of the beam extending below and along said bottom layer;

at least one right triangular reinforcing member embedded within the barrier member with one leg of the reinforcing member extending along the upper flange of the beam, the second leg facing toward the obstacle, and the hypotenuse facing toward the traffic.

18. The barrier member of claim 15, further comprising:

a separate beam segment embedded in each end of the module in longitudinal alignment with each other, and such that each beam segment has a lower flange which extends below said bottom layer.

19. A roadside traffic barrier for restraining vehicles from impacting a roadside obstacle, comprising:

an elongated base member adapted to be positioned at a back end adjacent the obstacle and extending along the road toward the traffic;

said base member defining a first channel in its upper surface which extends along the length of the base member;

a pair of beams emedded in and extending along said first channel in parallel and laterally spaced relation, each beam including an upper flange whose upper surface is substantially flush with the plane of said first channel, said beams defining a second channel between the beams within the base member and below said first channel;

a plurality of rectangular, crushable, multi-layer modules of a first type disposed within said first channel in end-to-end relation along said first channel;

each module of said first type comprising a semi-crushable, higher strength bottom layer; a crushable, low strength intermediate layer; and crushable, intermediate strength, top layer;

each module of said first type further comprising a separate beam segment at each end of the module and embedded in the bottom of the bottom layer with the lower flange of the beam segment protruding beyond the bottom layer so as to be movable along said second channel and be held within said second channel by the flanges of said pair of beams embedded in said first channel;

at least one rectangular, multi-layer, crushable module of a second type adapted to be positioned adjacent the obstacle at the end of the linear array of said modules of said first type in said first channel;

each module of said second type comprising a semi-crushable, higher strength bottom layer; a crushable, low strength intermediate layer; and crushable, intermediate strength, top layer;

each module of said second type further comprising an S-beam or similar wide flange beam embedded in the bottom of the bottom layer with the lower flange of the beam extending below and along said bottom layer;

each module of said second type further comprising at least one right triangular reinforcing member embedded within the barrier member with one leg of the reinforcing member extending along the upper flange of the beam, the second leg facing toward the obstacle, and the hypotenuse facing toward the traffic.

* * * * *